US007846530B2

(12) United States Patent
Keck et al.

(10) Patent No.: US 7,846,530 B2
(45) Date of Patent: Dec. 7, 2010

(54) CREPED ELECTRET NONWOVEN WIPER

(75) Inventors: Laura Elizabeth Keck, Alpharetta, GA (US); Eugenio Go Varona, Marietta, GA (US); Alan Edward Wright, Woodstock, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1496 days.

(21) Appl. No.: 10/950,881

(22) Filed: Sep. 27, 2004

(65) Prior Publication Data

US 2006/0068167 A1 Mar. 30, 2006

(51) Int. Cl.
*A61F 13/15* (2006.01)

(52) U.S. Cl. ..... 428/152; 428/175

(58) Field of Classification Search ..... 428/141, 428/152, 153, 174, 175
See application file for complete search history.

(56) References Cited

U.S. PATENT DOCUMENTS

| | | | | |
|---|---|---|---|---|
| 3,144,671 | A | 8/1964 | Gould et al. | |
| 3,423,266 | A | 1/1969 | Davies et al. | |
| 3,595,731 | A | 7/1971 | Davies et al. | |
| 3,692,618 | A | 9/1972 | Dorschner et al. | |
| 3,802,817 | A | 4/1974 | Matsuki et al. | |
| 3,849,241 | A | 11/1974 | Butin et al. | |
| 3,855,046 | A | 12/1974 | Hansen et al. | |
| 4,041,203 | A | 8/1977 | Brock et al. | |
| 4,100,324 | A | 7/1978 | Anderson et al. | |
| 4,215,682 | A | 8/1980 | Kubik et al. | |
| 4,340,563 | A | 7/1982 | Appel et al. | |
| 4,375,718 | A | 3/1983 | Wadsworth et al. | |
| 4,488,928 | A | 12/1984 | Ali Khan et al. | |
| 4,493,868 | A | 1/1985 | Meitner | |
| 4,592,815 | A | 6/1986 | Nakao | |
| 4,766,029 | A | 8/1988 | Brock et al. | |
| 4,810,556 | A | 3/1989 | Kobayashi et al. | |
| 4,818,464 | A | 4/1989 | Lau | |
| 4,874,659 | A | 10/1989 | Ando et al. | |
| 4,965,122 | A | 10/1990 | Morman | |
| 4,981,747 | A | 1/1991 | Morman | |
| 5,094,717 | A | 3/1992 | Manning et al. | |
| 5,108,820 | A | 4/1992 | Kaneko et al. | |
| 5,169,706 | A | 12/1992 | Collier, IV et al. | |
| 5,226,992 | A | 7/1993 | Morman | |
| 5,272,236 | A | 12/1993 | Lai et al. | |
| 5,278,272 | A | 1/1994 | Lai et al. | |
| 5,332,613 | A | 7/1994 | Taylor et al. | |
| 5,336,545 | A | 8/1994 | Morman | |
| 5,336,552 | A | 8/1994 | Strack et al. | |
| 5,382,400 | A | 1/1995 | Pike et al. | |
| 5,401,446 | A | 3/1995 | Tsai et al. | |
| 5,464,688 | A | 11/1995 | Timmons et al. | |
| 5,539,056 | A | 7/1996 | Yang et al. | |
| 5,596,052 | A | 1/1997 | Resconi et al. | |
| 5,620,779 | A | 4/1997 | Levy et al. | |
| 5,858,515 | A | 1/1999 | Stokes et al. | |
| 5,990,377 | A * | 11/1999 | Chen et al. | 604/381 |
| 6,080,466 | A | 6/2000 | Yoshimura et al. | |
| 6,150,002 | A | 11/2000 | Varona | |
| 6,162,535 | A | 12/2000 | Turkevich et al. | |
| 6,197,404 | B1 | 3/2001 | Varona | |
| 6,243,909 | B1 | 6/2001 | Graham et al. | |
| 6,446,691 | B1 | 9/2002 | Maldonado et al. | |
| 6,513,184 | B1 | 2/2003 | Brown et al. | |
| 6,530,108 | B1 | 3/2003 | Brown et al. | |
| 6,550,639 | B2 | 4/2003 | Brown et al. | |
| 6,560,813 | B2 | 5/2003 | Brown et al. | |
| 6,573,205 | B1 | 6/2003 | Myers et al. | |
| 6,619,947 | B2 | 9/2003 | Maldonado et al. | |
| 6,632,386 | B2 | 10/2003 | Shelley et al. | |
| 6,759,356 | B1 | 7/2004 | Myers | |
| 6,835,264 | B2 * | 12/2004 | Sayovitz et al. | 156/183 |
| 2003/0201579 | A1 | 10/2003 | Gordon et al. | |

FOREIGN PATENT DOCUMENTS

| | | |
|---|---|---|
| GB | 811030 | 3/1959 |
| GB | 2061709 A | 5/1981 |
| WO | WO 00/00267 | 1/2000 |
| WO | WO 02/054927 | 7/2002 |
| WO | WO 03/017901 | 3/2003 |
| WO | WO 03/054269 | 7/2003 |
| WO | WO 03/054273 | 7/2003 |
| WO | WO 2005/065727 | 7/2005 |

OTHER PUBLICATIONS

Patent Abstracts of Japan, JP 06240551 A, Aug. 30, 1994.
Patent Abstracts of Japan, JP 11099636 A, Apr. 13, 1999.
Patent Abstracts of Japan, JP 2003061886 A, Mar. 4, 2003.

* cited by examiner

*Primary Examiner*—Alicia Chevalier
(74) *Attorney, Agent, or Firm*—Ralph H. Dean, Jr.

(57) ABSTRACT

Disclosed herein are disposable fibrous nonwoven wipers which include one or more creped fibrous nonwoven webs which have been electret treated. The fibrous nonwoven wipers provide desirable properties including improved capacity and efficiency for picking up debris such as dirt, dust and particulate matter and enhanced particle attraction and containment properties. Also disclosed herein is a method for making the fibrous nonwoven wipers.

15 Claims, 1 Drawing Sheet

CREPED ELECTRET NONWOVEN WIPER

BACKGROUND OF THE INVENTION

Durable cloth and disposable paper towels and nonwoven wipers or cleaning fabrics have heretofore been used for dusting and routine surface cleaning in households and other settings, as both hand held wipers such as dust rags and implement- or handle-mounted dust mops and dusters. Cloth wipers such as terry cloth and braided dust mop cloths have a large capacity for holding dust and other particulate debris, but are too expensive to dispose of when soiled and so must be laundered prior to being re-used. Nonwoven wipers and paper towels or cleaning fabrics are more suited to being utilized as or as components of disposable wipers or cleaning fabrics, because their manufacture is often inexpensive relative to the cost of cloth type wiping fabrics. However, such disposable paper towels and nonwoven fabric wipers may have a more limited capacity for holding dust and other particulate debris and/or may have a more limited ability for picking up or attracting, and retaining dust or other debris.

Therefore, there remains a need for a wiper or cleaning fabric having a combination of desirable properties including improved capacity, efficiency and particle attraction and containment properties. In addition, it would be highly advantageous to provide such an improved wiper in a manner consistent with the costs dictated by the disposable applications for items which are utilized in limited- or single-use disposable products.

SUMMARY OF THE INVENTION

The present invention provides a nonwoven wiper that has enhanced dirt, dust and/or debris pick up and retention properties. The nonwoven wiper includes at least one fibrous nonwoven web material which is a creped and electret treated nonwoven web. Desirably, the fibrous nonwoven web is at least partially covered with a creping agent and includes regions of out-of-plane bending. The creping agent may desirably be an adhesive such as a hot melt adhesive. The fibrous nonwoven web used in the nonwoven wiper may include creped interfiber bonded regions alternating with regions of no interfiber bonding, where the interfiber bonded regions are creped so as to exhibit out-of-plane bending. The nonwoven web may desirably be bonded with a point bonded bond pattern, or a point unbonded bond pattern. The at least one fibrous nonwoven web material of the nonwoven wiper may desirably be a creped nonwoven web selected from spunbond webs, meltblown webs, coformed webs, hydroentangled webs, airlaid webs and carded webs, and the fibers of the fibrous nonwoven web material may desirably include a thermoplastic polymer such as polyolefins and/or polyesters. Suitable polyolefins include polypropylenes, polyethylenes, propylene-ethylene copolymers and blends thereof. The fibers of the fibrous nonwoven web may also be multicomponent fibers.

The nonwoven may desirably further include additional layers, such as one or more additional fibrous nonwoven web materials laminated to the creped and electret treated fibrous nonwoven web material. Such further layers may be such as spunbond webs, meltblown webs, coformed webs, hydroentangled webs, airlaid webs and carded webs. Also provided are cleaning implements, such as, for example, mops and dusters, including the nonwoven wiper.

The invention also provides a method for producing a creped electret nonwoven wiper, which includes the steps of providing a fibrous nonwoven web material, adhering the fibrous nonwoven web to a creping roll with a creping agent, removing the fibrous nonwoven web from the creping roll by creping the nonwoven web from the creping roll to produce a creped nonwoven web, and thereafter passing the nonwoven web material through an applied electric field. The method may desirably further include the step of bonding the fibrous nonwoven web with a point bonded thermal bonding pattern, and the fibrous nonwoven web may be bonded after adhering the fibrous nonwoven web to the creping roll and prior to removing the fibrous nonwoven web from the creping roll. Alternatively, the fibrous nonwoven web may be bonded prior to the step of adhering the fibrous nonwoven web to the creping roll.

DEFINITIONS

Figure 1:
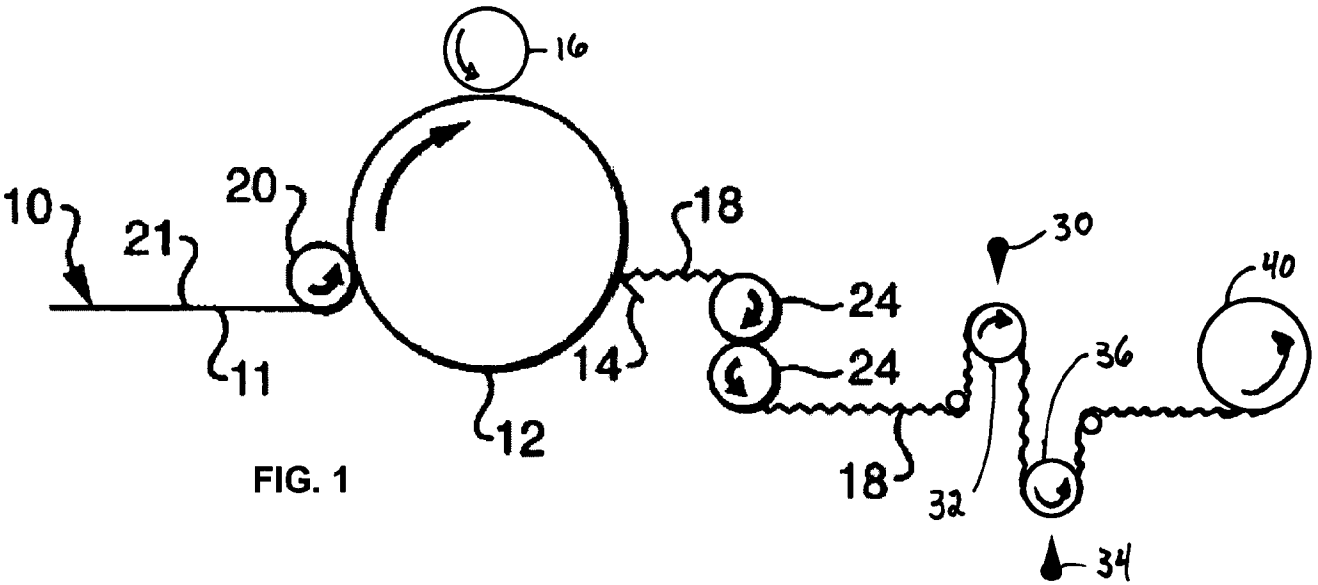
FIG. 1 schematically illustrates a process for forming a creped electret treated nonwoven web.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to, isotactic, syndiotactic and random symmetries. As used herein the term "thermoplastic" or "thermoplastic polymer" refers to polymers that will soften and flow or melt when heat and/or pressure are applied, the changes being reversible.

As used herein the term "fibers" refers to both staple length fibers and substantially continuous filaments, unless otherwise indicated. As used herein the term "substantially continuous" with respect to a filament or fiber means a filament or fiber having a length much greater than its diameter, for example having a length to diameter ratio in excess of about 15,000 to 1, and desirably in excess of 50,000 to 1.

As used herein the term "monocomponent" fiber refers to a fiber formed from one or more extruders using only one polymer composition. This is not meant to exclude fibers or filaments formed from one polymeric extrudate to which small amounts of additives have been added for color, antistatic properties, lubrication, hydrophilicity, etc.

As used herein the term "multicomponent fibers" refers to fibers or filaments that have been formed from at least two component polymers, or the same polymer with different properties or additives, extruded from separate extruders but spun together to form one fiber or filament. Multicomponent fibers are also sometimes referred to as conjugate fibers or bicomponent fibers, although more than two components may be used. The polymers are arranged in substantially constantly positioned distinct zones across the cross-section of the multicomponent fibers and extend continuously along the length of the multicomponent fibers. The configuration of such a multicomponent fiber may be, for example, a concentric or eccentric sheath/core arrangement wherein one polymer is surrounded by another, or may be a side by side arrangement, an "islands-in-the-sea" arrangement, or arranged as pie-wedge shapes or as stripes on a round, oval or rectangular cross-section fiber, or other configurations. Multicomponent fibers are taught in U.S. Pat. No. 5,108,820 to Kaneko et al. and U.S. Pat. No. 5,336,552 to Strack et al. Conjugate fibers are also taught in U.S. Pat. No. 5,382,400 to Pike et al. and may be used to produced crimp in the fibers by using the differential rates of expansion and contraction of the two (or more) polymers. For two component fibers, the polymers may be present in ratios of 75/25, 50/50, 25/75 or any other desired ratios. In addition, any given component of a multicomponent fiber may desirably comprise two or more polymers as a multiconstituent blend component.

As used herein the terms "biconstituent fiber" or "multiconstituent fiber" refer to a fiber or filament formed from at least two polymers, or the same polymer with different properties or additives, extruded from the same extruder as a blend. Multiconstituent fibers do not have the polymer components arranged in substantially constantly positioned distinct zones across the cross-section of the multicomponent fibers; the polymer components may form fibrils or protofibrils that start and end at random.

As used herein the terms "nonwoven web" or "nonwoven fabric" refer to a web having a structure of individual fibers or filaments that are interlaid, but not in an identifiable manner as in a knitted or woven fabric. Nonwoven fabrics or webs have been formed from many processes such as for example, meltblowing processes, spunbonding processes, coforming processes, airlaying processes, and carded web processes. The basis weight of nonwoven fabrics is usually expressed in grams per square meter (gsm) or ounces of material per square yard (osy) and the fiber or filament diameters useful are usually expressed in microns. (Note that to convert from osy to gsm, multiply osy by 33.91).

The terms "spunbond" or "spunbond nonwoven web" refer to a nonwoven fiber or filament material of small diameter fibers that are formed by extruding molten thermoplastic polymer as fibers from a plurality of capillaries of a spinneret. The extruded fibers are cooled while being drawn by an eductive or other well known drawing mechanism. The drawn fibers are deposited or laid onto a forming surface in a generally random manner to form a loosely entangled fiber web, and then the laid fiber web is subjected to a bonding process to impart physical integrity and dimensional stability. The production of spunbond fabrics is disclosed, for example, in U.S. Pat. No. 4,340,563 to Appel et al., U.S. Pat. No. 3,692,618 to Dorschner et al., and U.S. Pat. No. 3,802,817 to Matsuki et al., all incorporated herein by reference in their entireties. Typically, spunbond fibers or filaments have a weight-per-unit-length in excess of about 1 denier and up to about 6 denier or higher, although both finer and heavier spunbond fibers can be produced. In terms of fiber diameter, spunbond fibers often have an average diameter of larger than 7 microns, and more particularly between about 10 and about 25 microns, and up to about 30 microns or more.

As used herein the term "meltblown fibers" means fibers or microfibers formed by extruding a molten thermoplastic material through a plurality of fine, usually circular, die capillaries as molten threads or filaments or fibers into converging high velocity gas (e.g. air) streams that attenuate the fibers of molten thermoplastic material to reduce their diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Buntin. Meltblown fibers may be continuous or discontinuous, are often smaller than 10 microns in average diameter and are frequently smaller than 7 or even 5 microns in average diameter, and are generally tacky when deposited onto a collecting surface.

As used herein, an "airlaid" web is a fibrous web structure formed primarily by a process by which bundles of small fibers having typical lengths ranging from about 3 to about 50 millimeters (mm) are separated and entrained in an air supply or air stream and then deposited onto a forming screen or other foraminous forming surface, usually with the assistance of a vacuum supply, in order to form a dry-laid fiber web. Typically following deposition the web is densified and/or bonded by such means as thermal bonding or adhesive bonding. Equipment for producing air-laid webs includes the Rando-Weber air-former machine available from Rando Corporation of New York and the Dan-Web rotary screen air-former machine available from Dan-Web Forming of Risskov, Denmark. Generally the web comprises cellulosic fibers such as those from fluff pulp that have been separated from a mat of fibers, such as by a hammermilling process, and may also include other fibers such as synthetic staple fibers or binder fibers, super absorbent materials, etc. "Cellulosic" fibers can include materials having cellulose as a major constituent, typically 50 percent by weight or more cellulose or a cellulose derivative, and includes such as cotton, typical wood pulps, non-woody cellulosic fibers, cellulose acetate, cellulose triacetate, rayon, thermomechanical wood pulp, chemical wood pulp, debonded chemical wood pulp, milkweed, and bacterial cellulose.

As used herein "carded webs" refers to nonwoven webs formed by carding processes as are known to those skilled in the art and further described, for example, in U.S. Pat. No. 4,488,928 to Alikhan and Schmidt which is incorporated herein in its entirety by reference. Briefly, carding processes involve starting with staple fibers in a bulky batt that is combed or otherwise treated to provide a web of generally uniform basis weight. Typically, the webs are thereafter bonded by such means as through-air bonding, thermal point bonding, adhesive bonding, and the like.

As used herein "coform" or "coform web" refers to nonwoven webs formed by a process in which at least one meltblown diehead is arranged near a chute or other delivery device through which other materials are added while the web is being formed. Such other materials as may be added include staple fibers, cellulosic fibers, and/or superabsorbent materials and the like. Coform processes are described in U.S. Pat. No. 4,818,464 to Lau and U.S. Pat. No. 4,100,324 to Anderson et al., the disclosures of which are incorporated herein by reference in their entirety.

As used herein, "thermal point bonding" involves passing a fabric or web of fibers or other sheet layer material to be bonded between a heated calender roll and an anvil roll. The calender roll is usually, though not always, patterned on its surface in some way so that the entire fabric is not bonded across its entire surface. As a result, various patterns for calender rolls have been developed for functional as well as aesthetic reasons. One example of a pattern has points and is the Hansen Pennings or "H&P" pattern with about a 30 percent bond area with about 200 bonds per square inch (about 31 bonds per square centimeter) as taught in U.S. Pat. No. 3,855,046 to Hansen and Pennings. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5 percent. Another typical point bonding pattern is the expanded Hansen and Pennings or "EHP" bond pattern which produces a 15 percent bond area with a square pin having a side dimension of 0.037 inches (0.94 mm), a pin spacing of 0.097 inches (2.464 mm) and a depth of 0.039 inches (0.991 mm). Other common patterns include a high density diamond or "HDD pattern", which comprises point bonds having about 460 pins per square inch (about 71 pins per square centimeter) for a bond area of about 15 percent to about 23 percent, a "Ramish" diamond pattern with repeating diamonds having a bond area of about 8 percent to about 14 percent and about 52 pins per square inch (about 8 pins per square centimeter) and a wire weave pattern looking as the name suggests: e.g. like a window screen. As still another example, the nonwoven web may be bonded with a point bonding method wherein the arrangement of the bond elements or bonding "pins" are arranged such that the pin elements have a greater dimension in the machine direction than in the cross-machine direction. Linear or rectangular-shaped pin elements with the major axis aligned substantially in the machine direction are examples of this. Alternatively, or in addition, useful bonding patterns may have pin elements arranged so as to leave machine direction running "lanes" or lines of unbonded or substantially unbonded regions running in the machine direction, so that the nonwoven web material has additional give or extensibility in the cross machine direction. Such bonding patterns as are described in U.S. Pat. No. 5,620,779 to Levy and McCormack, incorporated herein by reference in its entirety, may be useful, such as for example the "rib-knit" bonding pattern therein described. Typically, the percent bonding area varies from around 10 percent to around 30 percent or more of the area of the fabric or web. Another known thermal calendering bonding method is the "pattern unbonded" or "point unbonded" or "PUB" bonding as taught in U.S. Pat. No. 5,858,515 to Stokes et al., wherein continuous bonded areas define a plurality of discrete unbonded areas. Thermal bonding (point bonding or point-unbonding) imparts integrity to individual layers or webs by bonding fibers within the layer and/or for laminates of multiple layers, such thermal bonding holds the layers together to form a cohesive laminate material.

As used herein, "creped" refers to a fibrous nonwoven web having portions which are bent out-of-plane using a variety of creping techniques known in the art. Creped nonwoven webs have top and/or bottom surfaces which define a three-dimensional structure. The three-dimensional structure is manifested in the form of puckering, waves, peaks and valleys, etc., so that some regions of the fibrous nonwoven web are substantially elevated or depressed relative to adjacent regions.

As used herein, "permanently creped" refers to a creped nonwoven web having bonded and unbonded areas, in which the bonded areas are permanently bent out-of-plane and the unbonded portions are permanently looped, such that the nonwoven web cannot be returned to its original uncreped state by applying a mechanical stress.

As used herein, "crepe level" is a measure of creping and is calculated according to the following equation:

$$\text{Crepe level}(\%)=100*[(A-B)/A]$$

where:

A=Speed of Creping Surface

B=Speed of windup reel for the creped web

As used herein, "bent out-of-plane" refers to a bonding or orientation of portions of the nonwoven web in a direction away from the plane in which the nonwoven web substantially lies before being subjected to the creping process. As used herein, the phrase "bent out-of-plane" generally refers to nonwoven webs having creped portions bent at least about 15 degrees away from the plane of the uncreped nonwoven web, and desirably at least about 30 degrees.

As used herein, "looped" refers to unbonded fibers or portions of fibers in a creped nonwoven web which define an arch, semi-circle or similar configuration extending above the plane of the uncreped nonwoven web, and terminating at both ends in the nonwoven web (e.g., in the bonded areas of the creped nonwoven web).

DETAILED DESCRIPTION OF THE INVENTION

The present invention provides an efficient nonwoven wiper which is useful for cleaning up particulate matter and other debris such as hair (both human and pet), dust, food particles such as crumbs from baked goods and the like, grass, dirt, defoliated skin, 10 and other such items. The nonwoven wiper comprises at least one fibrous nonwoven web material which has been creped and electret treated, and desirably provides at least one web surface having a three-dimensional structure where regions exhibit out-of-plane bending. Desirably, the creping process results in interfiber bonded regions that exhibit permanent out-of-plane bending alternating with regions of no interfiber bonding wherein looped unbonded fiber portions extend above the plane. The creping process and resultant looped unbonded fiber regions provide void volume within the structure of the nonwoven web in which to capture particles and other debris, enabling it to contain more particles and/or to effectively contain larger or coarser particles of debris. In addition, the fibrous nonwoven web used in the nonwoven wiper is also electret treated, which provides for a higher affinity or attraction between the nonwoven wiper and such particles and debris as are present on a surface desired to be cleaned. Also provided is a method for producing a creped electret nonwoven wiper.

The invention will be described with reference to the following description and Figures which illustrate certain embodiments. It will be apparent to those skilled in the art that these embodiments do not represent the full scope of the invention which is broadly applicable in the form of variations and equivalents as may be embraced by the claims appended hereto. Furthermore, features described or illustrated as part of one embodiment may be used with another embodiment to yield still a further embodiment. It is intended that the scope of the claims extend to all such variations and equivalents.

FIG. 1 shows a general schematic demonstrating a suitable process for making the creped and electret treated nonwoven webs useful in the wiper products of the present invention. A fibrous nonwoven web 10, having a first side 11 and a second side 21, is supplied to the treatment process. The fibrous nonwoven web 10 may be supplied directly from a nonwoven web formation process. Generally, for the purposes of the treatment process embodiment shown in FIG. 1, the fibrous nonwoven web 10 has not been previously bonded. However, the web may be subjected to an initial consolidation by use of a compaction roller set or a hot air knife as is known in the art, so that the fibrous nonwoven web has sufficient integrity as a web to be carried through the treatment process without disintegrating. The fibrous nonwoven web 10 is fed through the process to optional press roll 20 which engages the first side 11 of the fibrous nonwoven web 10 against the creping roll 12 by guiding the fibrous nonwoven web 10 onto the creping roll 12. The press roll 20, when present, also supplies sufficient pressure to the fibrous nonwoven web 10 to adhere the web 10 to the creping roll 12. When a press roll 20 is not used in the process, the pressure supplied by the bonding roll 16 will adhere the fibrous nonwoven web to the creping roll.

In order to adhere the fibrous nonwoven web 10 to the creping roll 12, a creping agent may be used. The creping agent is desirably an adhesive which is capable of holding the fibrous nonwoven web 10 to the creping roll 12 and which may be applied to the fibrous nonwoven web 10 or applied onto the creping roll 12. Suitable creping agents include, for example, aqueous based adhesives, hot melt adhesives and solvent based adhesives as are known in the art. Such adhesives may be applied by any suitable means (not shown) capable of applying the adhesive to at least a portion of the first side 11 of the fibrous nonwoven web 10 which is to contact creping roll 12. Such application methods include spraying, printing, dipping and slot coating, and the like. In the alternative, the creping agent or adhesive may be applied directly to the surface of the creping roll 12 and thereby applied to the web 10 as it contacts the creping roll 12. In addition to acting as a creping agent, an adhesive may also provide the finished wiper product with further improved particle or debris retention properties.

Examples of suitable hot melt adhesives include styrene/rubber block copolymers, polybutylene, EVA (ethylene/vinyl acetate copolymer), polyester, polyamide, or olefin based adhesives. Commercial examples of hot melt adhesives usable in the present include those available from the Huntsman Polymer Corporation of Odessa, Tex. under the names RT 2115, RT 2130, RT 2315, RT 2330 and RT 2730; those available from Bostick-Findley Corporation of Wauwatosa, Wash. under the names H2525A and H2096; and those available from National Starch and Chemical Company of Bridgewater, N.J. under the names NS5610 and NS34-2950. Other commercially available suitable adhesives include acrylic polymer emulsions available from the National Starch and Chemical Company and sold under the name DUR-O-SET®, and acrylic carboxylated latex polymer emulsions available from Noveon, Inc. of Cleveland, Ohio under the trade name HYCAR®.

It should be noted that solvent and aqueous based adhesives may require the additional step of solvent or water removal such as by blowing air on the web material or applying heat to the web 10 and/or creping roll 12. As an alternative and/or in addition to the use of externally applied adhesives, tackifiers or other adhesive additives as are known in the art may supplied as a melt additive in the polymeric composition used in the production of the fibrous nonwoven web 10. Examples of such melt additives include hydrogenated hydrocarbon resins such as the REGALREZ® resins available from Hercules Incorporated of Wilmington, Del. and the ARKON® P resins available from Arakawa Chemical (U.S.A.) Incorporated of Chicago, Ill.

Returning to the description of FIG. 1, once the fibrous nonwoven web 10 is adhered to the creping roll 12, the fibrous nonwoven web 10 stays attached to the surface of creping roll 12 as the creping roll rotates. The fibrous nonwoven web 10 is brought into contact with a bonding roll 16. The bonding roll 16 has raised portions and recessed portions in a pattern. As the fibrous nonwoven web 10 is passed between the nip created between the bonding roll 16 and the creping roll 12, the raised portions of the bonding roll 16 come into contact with the fibrous nonwoven web 10 and press the web 10 against the creping roll 12. These raised portions of the bonding roll 16 bond the fibers of the fibrous nonwoven web 10 together at the points of contact. In order to bond the fibers of the fibrous nonwoven web 10, the bonding roll 16 may be heated to melt or fuse the fibers. The bonding roll 16 may have any bond pattern known to those skilled in the art and the bond pattern is not critical to the present invention. Examples of bond patterns include point bonded and point unbonded (PUB) bond patterns as described above.

As the fibrous nonwoven web 10 is passed between the nip of the bonding roll and the creping roll, the bonding roll 16 further adheres the fibrous nonwoven web to the surface of the creping roll 12. The adhesive applied to the fibrous nonwoven web or the creping roll is typically concentrated to a greater extent at the interfiber bond areas, causing still greater interfiber bonding in those areas. Essentially, the fibrous nonwoven web 10 is most strongly attached to the creping roll 12 in the pattern of bond points or bonded areas supplied by the bonding roll 16.

Returning to FIG. 1, as the creping roll moves toward the creping blade 14, the leading edge of the nonwoven web bonded to the surface is creped off of the creping roll 12 by the action of the creping blade 14. The creping blade 14 penetrates the adhesive bond between the fibrous nonwoven web 10 and the creping roll 12, bending the fibrous nonwoven web 10 and lifting it away from and off of the creping roll 12. Since the fibrous nonwoven web 10 is most strongly attached or essentially attached to the creping roll 12 in the bond pattern supplied by the bonding roll 16, the resulting fiber bending as the creping blade 14 lifts the web off of the creping roll 12 corresponds to the bond pattern in the nonwoven web. This results in looping of the fibers in the unbonded areas or areas of the fibrous nonwoven web 10 that are less strongly attached to the creping roll, and thus the creping action primarily or most strongly occurs at the bond points of the fibrous nonwoven web 10. Desirably, the creping action results in a permanent bending of the bonded areas such that the bonded areas are permanently bent out-of-plane.

The creped nonwoven web 18 may then be advanced by pull rolls 24 into an electret charging apparatus comprising electrode and charging drum pairs 30, 32 and 34, 36 to form an electret treated creped nonwoven web 38 which is wound up for storage or transport on wind-up roll 40. The electret charging apparatus will be discussed in more detail below with respect to FIG. 2. Once rolled, the creped and electret treated nonwoven web 38 may be transferred to another location and further processed to form wiper products containing the creped and electret treated nonwoven web. As an alternative to being wound up and stored on wind-up roll 40, the creped and electret treated nonwoven web may be directed immediately to various wiper products converting operations, or directed for further web processing.

Figure 2:
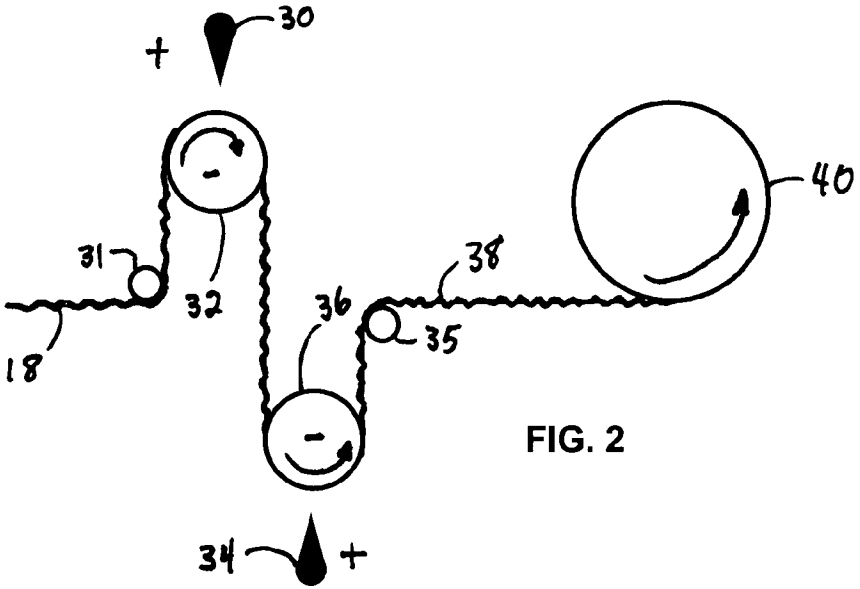
FIG. 2 schematically illustrates in more detail a process for electret treating a creped nonwoven web.

FIG. 2 illustrates in greater detail the electret charging portion of the process shown in FIG. 1. As can be seen in FIG. 2, the creped nonwoven web 18 is directed around guiding roller 31 and over the first charging drum 32 which rotates with the creped nonwoven web 18 and brings the web 18 into a position between the first charging drum 32, which has a negative electrical potential, and the first charging electrode 30, which has a positive electrical potential. As the creped nonwoven web 18 passes between the charging electrode 30 and the charging drum 32, electrostatic charges are developed in the creped nonwoven web 18. That is, a relative positive charge is developed in the side of the creped nonwoven web 18 which is in contact with the first charging drum 32, while a relative negative charge is developed in the side of web 18 not in contact with first charging drum 31. The creped nonwoven web 18 is then passed between a negatively charged second drum 36 and a positively charged second electrode 34, which reverses the polarities of the electrostatic charge previously imparted in the creped nonwoven web 18 and permanently imparts the newly developed electrostatic charge in the web. The creped and electret charged web 38 may then be passed around another guide roller and wound on roll 40.

One skilled in the art will recognize that while the charging drums are illustrated to have negative electrical potentials and the charging electrodes are illustrated to have positive electrical potentials for the purposes of discussion, the polarities of the drums and the electrodes can be reversed and/or the negative potential can be replaced with ground. The charging potentials useful for electret treating processes may vary with the field geometry of the electret treatment process. By way of example, the electric fields for the above-described electret charging process can be effectively operated between about 1 kVDC/cm and about 30 kVDC/cm, desirably between about 4 kVDC/cm and about 20 kVDC/cm, and still more particularly about 7 kVDC/cm to about 12 kVDC/cm, when the gap or distance between the charging drum and the electrode is between about 1.2 cm and about 5 cm. The above-described suitable electret charging process is further described in U.S. Pat. No. 5,401,446 to Tsai et al., incorporated herein by reference in its entirety. Other methods of electret treatment are known in the art and include those described in U.S. Pat. No. 4,375,718 to Wadsworth et al., U.S. Pat. No. 4,592,815 to Nakao and U.S. Pat. No. 4,874,659 to Ando et al., each incorporated herein by reference in its entirety.

Other or alternative methods of creping the fibrous nonwoven web are also suitable, such as are disclosed in U.S. Pat. No. 4,810,556 to Kobayashi et al., U.S. Pat. Nos. 6,197,404 and 6,150,002, both to Varona, and PCT publications WO 03/54273 and WO 03/54269, both published Jul. 3, 2003, all of which are incorporated herein by reference in their entireties. An example of an alternative to the creping process described above with respect to FIG. 1 is creping of the second side of the fibrous nonwoven web by passing the web through a second creping station. In this alternative embodiment, the opposite or second side 21 of the fibrous nonwoven web is adhered to a second creping drum so that the opposite side of the fibrous nonwoven web is creped. As another example, it is not required to bond and crepe the fibrous nonwoven web in the same step or process; i.e., a previously bonded fibrous nonwoven web may be provided either directly from a nonwoven web production process or by unwinding a supply roll of a previously produced nonwoven web and then creping and electret treating the web.

Generally speaking, the level of creping applied to the fibrous nonwoven web has a large impact on the amount of additional open area or void volume created within the fabric. The level of creping is related to the difference between the linear surface speed of the creping roll (faster) relative to the surface speed of the wind-up roll (slower), according to the equation presented above. However, as mentioned above, the creped and electret treated fibrous nonwoven web may not necessarily be stored in roll form but may be directed straight away to wiper product forming or converting operations. Therefore, stated another way, the level of creping relates to the speed differential between the linear rate of travel of the fibrous nonwoven web while on the creping roll relative to the linear rate of travel of the creped fibrous nonwoven web as it is being advanced away from the creping roll after being creped. Desirably, the crepe level will be between about 5 percent and 75 percent. More particularly, the crepe level will be at least about 15 percent and up to about 60 percent, and still more particularly between about 25 percent and about 50 percent.

The fibrous nonwoven web or webs suitable for use in the nonwoven wiper include spunbond webs, meltblown webs, coformed webs, hydroentangled webs, airlaid webs and carded webs as are known in the art and as are described above. The nonwoven wiper may desirably include other or additional web layers as a composite or laminate including the creped and electret treated fibrous nonwoven web. Such other web layers may be such as the spunbond, meltblown, coform, airlaid, carded and hydroentangled webs mentioned above. The additional web layer or layers may or may not also be creped and/or electret treated. In addition, other types of layers such as films, tissues, and foams may be used in the nonwoven wiper. Such additional layer or layers may be selected in order to provide additional or different functional properties to the nonwoven wiper, such as additional debris capacity, liquid absorbency, backing or barrier function, etc. Such a laminate or composite wiper may be produced by laminating the additional layer or layers to the creped and electret treated nonwoven web by methods as are known in the art, including such as thermal bonding, ultrasonic bonding, stitch bonding, adhesive bonding, entangling and the like. In addition, it should be noted that such a laminate may include bonding the two or more layers together substantially continuously along their face-to-face plane, intermittently along their face-to-face plane, or by bonding only the edges of the layers together to form a wiper composite having the layers bonded together along a portion or the entirety of the periphery of the wiper product.

Generally speaking, the basis weight of the fibrous nonwoven web or webs and/or the basis weight of optional additional layers may suitably be from about 7 gsm or less up to about 200 gsm or more, and more particularly may have a basis weight from about 10 gsm or less to about 100 gsm, and still more particularly, from about 14 gsm to about 68 gsm. Other examples are possible. The fibers selected for such nonwoven web or webs may desirably range in size as described above, that is, from very fine fibers such as meltblown fibers having diameters typically less than about 7 or even 5 microns in average diameter, to generally larger fibers such as spunbond or staple fibers having diameters typically greater than about 7 microns, and more typically greater than about 10 microns and up to about 30 microns, or greater. It should be noted that fiber size contributes to the openness or void volume of the creped nonwoven web in that, generally speaking, larger fibers promote a more open structure in the creped nonwoven web and may be more suitable for wiper products where it is anticipated that larger particles or debris such as food crumbs are to be picked up. Depending on end-use need, the fiber size may desirably be at least about 18 microns in average diameter, and more desirably at least about 20 microns in average diameter, or larger.

It should further be noted that the starting fibrous nonwoven web which is creped and electret treated may itself be a multi-layer structure. Particular examples of multilayer laminate construction for the fibrous nonwoven web or webs include spunbond-meltblown and spunbond-meltblown-spunbond laminates such as are described in U.S. Pat. Nos. 4,041,203 and 4,766,029 to Brock et al., U.S. Pat. No. 5,464,688 to Timmons et al. and U.S. Pat. No. 5,169,706 to Collier et al., all of which are incorporated herein by reference in their entireties. As another example, where a spunbond fibrous nonwoven web is selected as the starting web, the spunbond web itself may be produced on a multiple spin bank machine where a subsequent spin bank deposits fibers atop a layer of just-deposited fibers from a previous spin bank, and so in this regard such an individual spunbond nonwoven web may be thought of as a multi-layered structure. In this situation, the various layers of deposited fibers in the starting fibrous nonwoven web may be the same, or they may be different in basis weight and/or in terms of the composition, type, size, level of crimp, and/or shape of the fibers produced.

Other embodiments include the use of crimped fiber nonwoven webs. The characteristics or physical properties of fibrous nonwoven webs are controlled, at least in part, by the density or openness of the starting fabric. Generally speaking, fibrous nonwoven webs made from crimped filaments or fibers have a lower density and higher loft compared to similar nonwoven webs of uncrimped fibers, and therefore use of a crimped fibrous nonwoven web, if desired, may provide even higher amounts of void volume for particle capture than creping of non-crimped fiber webs. Various methods of crimping melt-spun multicomponent fibers are known in the art. As disclosed in U.S. Pat. Nos. 3,595,731 and 3,423,266 to Davies et al., incorporated herein by reference in their entireties, bicomponent fibers may be mechanically crimped and the resultant fibers formed into a nonwoven web or, if the appropriate polymers are used, a latent helical crimp produced in bicomponent fibers may be activated by heat treatment of the formed web. Alternatively, as disclosed in U.S. Pat. No. 5,382,400 to Pike et al., incorporated herein by reference in its entirety, the heat treatment may be used to activate the latent helical crimp in the fibers before the fibers have been formed into a nonwoven web. As an alternative to bicomponent fibers, fiber crimp may be produced in homofilament fibers (fibers having one polymer component) by utilizing the teachings disclosed in U.S. Pat. No. 6,632,386 to Shelley and Brown, U.S. Pat. No. 6,446,691 to Maldonado et al. and U.S. Pat. No. 6,619,947 to Pike et al., all incorporated herein by reference in their entireties.

Another advantage in using a creped electret treated fibrous nonwoven web in or as a wiper is that the web tends to have at least a certain amount of additional extensibility in the machine direction (the direction of formation or direction of feeding through the creping process). In addition, if it is desired to have the creped fibrous nonwoven web also have transverse extensibility, the fibrous nonwoven web or webs may be supplied as "necked" nonwoven webs. A "necked" nonwoven web is one which has been elongated in one direction, usually the machine direction, causing rugosities to form across the web and, generally, causing the web to decrease or become compacted in its transverse dimension. Necking of web materials is disclosed for example by U.S. Pat. Nos. 5,336,545, 5,226,992, 4,981,747 and 4,965,122 to Morman, all incorporated herein by reference in their entireties.

Polymers suitable for making the creped and electret treated fibrous nonwoven web and/or the optional additional web or webs include those fiber-forming polymers known to be generally suitable in the making of nonwoven webs such as spunbond, meltblown, coform, carded webs and the like, and include for example polyolefins, polyesters, polyamides, polycarbonates and copolymers and blends thereof. It should be noted that the polymer or polymers may desirably contain other additives such as processing aids or treatment compositions to impart desired properties to the fibers, residual amounts of solvents, pigments or colorants and the like.

Suitable polyolefins include polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and atactic polypropylene; polybutylene, e.g., poly(1-butene) and poly(2-butene); polypentene, e.g., poly(1-pentene) and poly(2-pentene); poly(3-methyl-1-pentene); poly(4-methyl-1-pentene); and copolymers and blends thereof. Suitable copolymers include random and block copolymers prepared from two or more different unsaturated olefin monomers, such as ethylene/propylene and ethylene/butylene copolymers. Suitable polyamides include nylon 6, nylon 6/6, nylon 4/6, nylon 11, nylon 12, nylon 6/10, nylon 6/12, nylon 12/12, copolymers of caprolactam and alkylene oxide diamine, and the like, as well as blends and copolymers thereof. Suitable polyesters include poly(lactide) and poly(lactic acid) polymers as well as polyethylene terephthalate, polybutylene terephthalate, polytetramethylene terephthalate, polycyclohexylene-1,4-dimethylene terephthalate, and isophthalate copolymers thereof, as well as blends thereof.

Many elastomeric polymers are also known to be suitable as fiber-forming resins, although it should be noted that, for the fibrous nonwoven web which is to be creped, high levels of creping may be more easily achieved using substantially non-elastic polymers. Elastic polymers include, for example, elastic polyesters, elastic polyurethanes, elastic polyamides, elastic co-polymers of ethylene and at least one vinyl monomer, block copolymers, and elastic polyolefins. Examples of elastic block copolymers include those having the general formula A-B-A' or A-B, where A and A' are each a thermoplastic polymer endblock that contains a styrenic moiety such as a poly (vinyl arene) and where B is an elastomeric polymer midblock such as a conjugated diene or a lower alkene polymer such as for example polystyrene-poly(ethylene-butylene)-polystyrene block copolymers. Also included are polymers composed of an A-B-A-B tetrablock copolymer, as discussed in U.S. Pat. No. 5,332,613 to Taylor et al. An example of such a tetrablock copolymer is a styrene-poly (ethylene-propylene)-styrene-poly(ethylene-propylene) or SEPSEP block copolymer. These A-B-A' and A-B-A-B copolymers are available in several different formulations from the Kraton Polymers U.S., LLC, of Houston, Tex. under the trade designation KRATON®. Other commercially available block copolymers include the SEPS or styrene-poly(ethylene-propylene)-styrene elastic copolymer available from Kuraray Company, Ltd. of Okayama, Japan, under the trade name SEPTON®.

Examples of elastic polyolefins include ultra-low density elastic polypropylenes and polyethylenes, such as those produced by "single-site" or "metallocene" catalysis methods. Such polymers are commercially available from the Dow Chemical Company of Midland, Mich. under the trade name ENGAGE®, and described in U.S. Pat. Nos. 5,278,272 and 5,272,236 to Lai et al. entitled "Elastic Substantially Linear Olefin Polymers". Also useful are certain elastomeric polypropylenes such as are described, for example, in U.S. Pat. No. 5,539,056 to Yang et al. and U.S. Pat. No. 5,596,052 to Resconi et al., incorporated herein by reference in their entireties, and polyethylenes such as AFFINITY® EG 8200 from Dow Chemical of Midland, Mich. as well as EXACT® 4049, 4011 and 4041 from the ExxonMobil Chemical Company of Houston, Tex., as well as blends.

In order to assist in the fibrous nonwoven web's ability to accept a charge during electret treatment, or to provide a more durable and/or temperature stable electret charge, various ferro-electric additives and/or specialized polymer blends, grafted polymers or telechelic polymers or "telomers" may be incorporated into the polymer melt when forming the fibers of the fibrous nonwoven web. Suitable electret-enhancing additives and compositions are taught, for example, in U.S. Pat. No. 6,162,535 to Turkevich et al., U.S. Pat. No. 6,573,205 to Myers et al., U.S. Pat. No. 6,759,356 to Myers, all incorporated herein by reference in their entireties.

While not described herein, various additional potential processing and/or finishing steps known in the art such as slitting, treating, aperturing, printing of graphics, or further lamination of the creped and electret treated nonwoven web into a composite with other materials, such as backing films or other nonwoven layers, may be performed without departing from the spirit and scope of the invention. General examples of web material treatments include or one or more treatments to impart wettability or hydrophilicity to a web comprising hydrophobic thermoplastic material, although it should be noted that wettability treatments may decrease the ability of a nonwoven web to accept or maintain electret charge. Wettability treatment additives may be incorporated into the polymer melt as an internal treatment, or may be added topically at some point following fiber or web formation. As another example of an additional processing or finishing step, the creped and electret treated material may be subjected to stretching in either the machine direction or cross machine direction, or both, such as by machine direction tensioning, tenter frames, or grooved rolling, in order to impart extensibility or additional levels of extensibility.

EXAMPLE

A fibrous spunbond nonwoven web was creped at about a 50 percent crepe level essentially according to the creping method described herein and electret treated also essentially as described herein. The spunbond fibers were polypropylene fibers of approximately 4 denier (about 25 microns in average diameter) and the web was bonded with a Ramish bond pattern. The creping agent used was National Starch and Chemical's DUR-O-SET® acrylic polymer emulsion adhesive. The basis weight of the starting fibrous nonwoven web was about 20 gsm and the basis weight of the resulting creped fibrous nonwoven web was about 45 gsm.

The prepared creped and electret treated fibrous nonwoven web was compared as a wiper to commercially available cleaning sheets, using the following test designed to evaluate the cleaning sheets' ability to pick up particulate matter or debris. One comparative cleaning sheet was a Swiffer® Disposable Cloths cleaning sheet available from the Procter & Gamble Company of Cincinnati, Ohio, and the second comparative cleaning sheet was a Pledge® Grab-It® Dry Cloths cleaning sheet available from S. C. Johnson and Son, Inc. of Racine, Wis. Both comparative cleaning sheets were hydroentangled nonwoven webs made from polyester staple fiber hydroentangled or spunlaced into a polypropylene scrim substrate sheet. The Swiffer® sheet had a basis weight of about 64 gsm and the Pledge® Grab-It® sheet had a basis weight of about 58 gsm. Ten samples of each sheet were tested and the results were averaged. A tray having a 18 inch by 24 inch (about 46 cm by 61 cm) linoleum floor surface with Lexan® polycarbonate sides which were 1.5 inch (about 3.8 cm) high was used to test the debris pick-up of the cleaning sheets. An 8.5 inch by 11 inch (about 21.6 cm by about 28 cm) sample of each cleaning sheet was attached to a mop head and handle assembly. A measured amount of debris (commercially available dried bread crumbs) was placed into the tray.

To test the pick-up of each cleaning sheet, the mop with attached cleaning sheet was wiped or swept across the linoleum floor surface twice. The amount of bread crumbs collected in each of the 10 samples tested for each cleaning sheet was measured by weighing the sheets before and after wiping or sweeping the cleaning sheet across the linoleum surface. The amount of crumb pick-up was then calculated as the percentage of the crumbs picked up based on the original amount of crumbs placed in the tray. The results are shown in Table 1 and, as can be seen, the nonwoven wiper of the present invention exhibits a superior debris pick-up as compared to the commercially available cleaning sheets. It should additionally be noted here that the nonwoven wiper of the present invention tested had a basis weight of less than 80 percent of either of the comparative cleaning sheets, so on a per-weight basis the Example nonwoven wiper is far superior.

TABLE 1

| Cleaning Sheet | Average % of crumb pick-up |
|---|---|
| Example | 48.6% |
| Swiffer ® | 39.2% |
| Pledge ® Grab-It ® | 36.1% |

The nonwoven wipers described herein are highly suited for use as hand held cleaning wipers for use in household, industrial and food service surfaces cleaning and wiping. In addition, the nonwoven wipers described herein are highly suitable for attachment to various cleaning implements such as dust mops for cleaning floors and dusters for cleaning other surfaces, and the like.

While various patents have been incorporated herein by reference, to the extent there is any inconsistency between incorporated material and that of the written specification, the written specification shall control. In addition, while the invention has been described in detail with respect to specific embodiments thereof, it will be apparent to those skilled in the art that various alterations, modifications and other changes may be made to the invention without departing from the spirit and scope of the present invention. It is therefore intended that the claims cover all such modifications, alterations and other changes encompassed by the appended claims.

The invention claimed is:

1. A nonwoven wiper comprising at least one fibrous nonwoven web material, said nonwoven web material being a creped and electret treated nonwoven web material, wherein said fibers of said at least one fibrous nonwoven web material comprise a thermoplastic polymer selected from the group consisting of polyolefins and polyesters.

2. The nonwoven wiper of claim 1 wherein said fibrous nonwoven web is at least partially covered with a creping agent and having regions of out-of-plane bending.

3. The nonwoven wiper of claim 2 wherein said fibrous nonwoven web comprises creped interfiber bonded regions alternating with regions of no interfiber bonding, said interfiber bonded regions being creped so as to exhibit out-of-plane bending.

4. The nonwoven wiper of claim 2 wherein said creping agent is a hot melt adhesive.

5. The nonwoven wiper of claim 1 wherein said at least one fibrous nonwoven web material is a creped nonwoven web selected from the group consisting of spunbond webs, meltblown webs, coformed webs, hydroentangled webs, airlaid webs and carded webs.

6. The nonwoven wiper of claim 5 wherein said at least one fibrous nonwoven web material is a spunbond web or a carded web and wherein the fibers of said at least one fibrous nonwoven web material are greater than about 20 microns in average diameter.

7. The nonwoven wiper of claim 5 wherein the fibers of said at least one fibrous nonwoven web material are multicomponent fibers.

8. The nonwoven wiper of claim 1 wherein said polyolefins are selected from the group consisting of polypropylenes, polyethylenes, propylene-ethylene copolymers and blends thereof.

9. The nonwoven wiper of claim 1 further comprising at least a second fibrous nonwoven web material laminated to said at least one fibrous nonwoven web material, said at least second fibrous nonwoven web material selected from the group consisting of spunbond webs, meltblown webs, coformed webs, hydroentangled webs, airlaid webs and carded webs.

10. The nonwoven wiper of claim 1 wherein said at least one fibrous nonwoven web material is a creped spunbond nonwoven web having a point bonded thermal bonding pattern.

11. The nonwoven wiper of claim 1 wherein said at least one fibrous nonwoven web material is a creped spunbond nonwoven web having a point unbonded thermal bonding pattern.

12. The nonwoven wiper of claim 1 wherein said at least one fibrous nonwoven web material has a level of creping of about 5 percent to about 75 percent.

13. The nonwoven wiper of claim 1 wherein said at least one fibrous nonwoven web material has a level of creping of about 15 percent to about 60 percent.

14. The nonwoven wiper of claim 1 wherein said at least one fibrous nonwoven web material has a level of creping of about 25 percent to about 50 percent.

15. A cleaning implement comprising of the nonwoven wiper of claim 1.

* * * * *